United States Patent [19]

Watts

[11] Patent Number: 5,071,728

[45] Date of Patent: Dec. 10, 1991

[54] ELECTROPHOTOGRAPHIC IMAGING METHOD INVOLVES STRIPPING TRANSFERRED TONER IMAGE AND TRANSFERRING SAME TO ALTERNATE SUBSTRATE

[75] Inventor: Ronald E. Watts, Bishops Stortford, United Kingdom

[73] Assignee: Minnesota Mining and Manufacturing Company, St. Paul, Minn.

[21] Appl. No.: 591,953

[22] Filed: Oct. 2, 1990

[30] Foreign Application Priority Data

Oct. 18, 1989 [GB] United Kingdom ..... 8923460.3

[51] Int. Cl.[5] ..... G03G 13/16

[52] U.S. Cl. ..... 430/126; 430/43; 430/47; 430/256; 430/257

[58] Field of Search ..... 430/126, 43, 47, 256, 430/257

[56] References Cited

U.S. PATENT DOCUMENTS 3,352,731 11/1967 Schwertz et al. ..... 430/126

3,535,112 10/1970 Dolce et al. ..... 430/126

*Primary Examiner*—David Welsh

*Attorney, Agent, or Firm*—Gary L. Griswold; Walter N. Kirn; Mark A. Litman

[57] ABSTRACT

An imaging method capable of producing high-resolution full color images on substrates such as flexible plastics sheets to form weatherable signs for exterior display, the method comprising:

(a) providing a plurality of carrier sheets, each comprising a flexible base material having on one surface thereof a strippable resin layer;

(b) imaging each carrier sheet by passage through an electrophotographic copying apparatus so that a toner image corresponding to a section of a desired image is deposited and fused on said strippable resin layer of each sheet;

(c) adhesively bonding the side of each carrier sheet bearing said toner image to a first substrate, each carrier sheet being positioned such that the desired image is formed from the arrangement of the imaged carrier sheets;

(d) stripping from the composite comprising the first substrate, toner image and resin layer, the flexible base material of each carrier sheet, and, (e) adhesively bonding a second substrate to said resin layer, wherein at least one of the first and second substrates is transparent.

17 Claims, No Drawings

ELECTROPHOTOGRAPHIC IMAGING METHOD INVOLVES STRIPPING TRANSFERRED TONER IMAGE AND TRANSFERRING SAME TO ALTERNATE SUBSTRATE

FIELD OF THE INVENTION

This invention relates to a method of imaging and in particular to an imaging method capable of producing high-resolution full colour images on substrates such as flexible plastics sheets.

BACKGROUND TO THE INVENTION

Images for outside display, e.g., graphic displays on vehicle sides etc. should exhibit durability and weatherability. There is currently a need for a method of producing such images that is cheap and simple, and suitable for single image or low volume production.

The advent of electrophotographic copying, commonly referred to as xerography or plain paper copying, has proved to be a highly successful process for reproduction of images on to paper with the inherent advantages of speed and reliability. In a conventional process, an electrostatic image of an object is formed on a recording member such as a plate or drum. The recording member may comprise a layer of photoconductive material, such as selenium, on a conductive metal layer. The latent electrostatic image which is formed on the photoconductive material is developed into a visible image by application of toner powder or liquid and the image is transferred to a sheet of paper and affixed thereon by fusing, e.g., by application of heat and pressure, to form a permanent print. Full colour images may be obtained by sequentially forming electrostatic colour separation images on the recording member and using magenta, cyan, yellow and black toners in turn.

More recent developments in plain paper copiers include the ability to electronically store an image and output the image in sections at a predetermined level of magnification. Thus, a relatively large image may be output as a series of A4 or A3 sized sections ("tiles"), each of which bears a portion of the final image. When the tiles are placed in edge-to-edge abutment (after trimming any overlaps), the complete image is displayed.

U.S. Pat. No. 4,657,831 describes an electrostatic proofing method whereby a full-colour toner image is deposited on a thermoplastic layer applied to a photoconductive member, then transferred along with the thermoplastic layer to an opaque substrate and finally over-laminated with a transparent layer. Examples are known of a toner image being formed on a photoconductive member and transferred to a transfer sheet (rather than plain paper), whence it is subsequently transferred by heat and/or pressure to another substrate. This method is frequently used to produce lettering or graphics on tee-shirts, etc. (as described in GB1,568,226 and GB1,570,201), or to produce dry-transfer materials for the graphic artwork industry (as described in EP094, 845 and GB2,079,219). None of these prior art methods addresses the problem of producing high-quality signs for outdoor use, and none of them is suitable for producing magnified images via the assembly of component "tiles".

The present invention utilises a plain paper copier to produce a toner image either as a single image or as a series of component tiles, which is transferred to a substrate and overlaminated to provide a durable image.

BRIEF SUMMARY OF THE INVENTION

According to the present invention there is provided a method of producing an image on a substrate which method comprises:

(a) providing a carrier sheet comprising a flexible base material having on one surface thereof a strippable resin layer;

(b) imaging the carrier by passage through an electrophotographic copying apparatus so that a toner image is deposited and fused on the resin layer;

(c) adhesively bonding a first substrate to the side of the carrier sheet bearing the toner image;

(d) stripping, from the flexible base material, the composite comprising the first substrate, toner image and resin layer, and, (e) adhesively bonding a second substrate to the resin layer of the composite, at least one of the first and second substrates being transparent.

DESCRIPTION OF PREFERRED EMBODIMENTS

The first and second substrates are preferably flexible and extensible plastics sheets thereby providing an image which is both weatherproof and conformable to curved surfaces and surface irregularities.

The carrier sheet comprises a base which may be substantially any flexible material, transparent or opaque, which does not melt, tear or distort on passage through a photocopier, and which allows subsequent stripping of the resin layer. The carrier sheet does not require a photoconductive layer as required in the electrostatic proofing method of U.S. Pat. No. 4,657,831 since the photocopier used in the invention possesses a recording member comprising a photoconductive layer. Suitable materials include paper or plastics, preferably coated with a release material such as silicone or fluoropolymer resins.

The amount of flexibility or rigidity which is required or allowable in a carrier sheet depends on the design of the copying machine.

Polyester thinner than 100microns is unreliable through copiers and is particularly prone to buckle in the fuser area whilst thicker material may be too rigid.

In the situation where a final image is to be composed from tiles and it is necessary to cut away overlaps, a suitable method is to trim off unimaged borders then to stick the tiles down reversibly to a work surface arranging them in precise registration. Cuts are then made to remove overlaps and produce butt joints.

It will be clear that depending on the number of tiles composing the final image, up to four thicknesses of sheet may need to be cut at one time. It has been found best to cut through four thicknesses simultaneously rather than to partially lift sheets to reduce the number of thicknesses. Such lifting increases the chances of misregister and of damaging the edges of images.

Cutting through four thicknesses of 100 micron polyester requires considerable pressure and can cause edge damage to the image, whereas four thicknesses of a suitable paper is easier to cut and generally results in better edges.

Paper having a grammage between $50g/m^2$ and $140g/m^2$ is useful but a preferred range is $70g/m^2$ to 110g/m². Four thicknesses of such paper can be cut reliably.

Another important property of the carrier sheet is its release value. Using the Release Paper Manufacturers Association test method, papers having a release value in the range o 10g to 25g/25 mm are generally acceptable. If the release is too easy then the coating is liable to strip in the copying machine and if the release is too tight then the polymer film with the image cannot be reliably lifted off.

It is also important that coated sheets remain essentially flat otherwise transport through the copier is impossible. Coating one side of a sheet of paper with an essentially water impermeable film makes it likely that it will not remain flat if exposed to the atmosphere since variations in humidity will cause differential absorption or desorption of water vapour causing curling. Ways of ensuring flatness over a broad range of humidity include, for example, adjusting the moisture content prior to coating or sealing the back surface. Preferred base materials are release papers Nos. 639, 3672 and 537 manufactured by L. Stace Limited.

The base material used to form the carrier sheet is coated with a resin layer which must be capable of accepting an electrostatic toner image without melting or sticking to the rollers of the photocopier, notably the heated rollers of the toner fusing station. However, a slight degree of softening may be tolerated to facilitate anchoring of the toner particles. The resin layer must be strippable (with the toner image) from the base material after it has passed through the toner fusing station. Suitable resins include, many polymers, such as poly(vinyl formal), poly(vinyl butyral), vinyl chloridevinylacetate co-polymers and styrene-acrylate copolymers. The preferred material is VAGH (a hydroxyl-modified vinyl chloride-vinyl acetate copolymer, having a composition of approximately 90% vinyl chloride, 4% vinyl acetate, with a hydroxyl content of approximately 2.3%, supplied by Union Carbide). The resin may be conveniently coated from solution, e.g., toluene, 2-butanone, etc., to give a dry thickness of from 0.5 to 8 microns, preferably 1 to 5 microns.

Toner powders can contain in the region of 80% of a thermoplastic and the precise composition of the powders can vary between models of photocopier. It is also common practice for the powder image fusing rollers to have a thin coating of silicone oil which can appear on either side of the image and can reduce interlayer adhesion.

In order to optimise the cohesion of the final laminated construction, it is important to wipe off any silicone oil which may be left on the image by hot rollers of the photocopier. It is therefore necessary that the image particles are well fused together, well attached to the resin layer, and that the resin layer has good cohesion and is adequately attached to the base material, otherwise damage to the image will result. This is in contrast to the materials and methods taught in the prior art, involving loosely or un-fused toner images (GB1,568,226) and/or resin layers with low cohesion (EP094,845). These factors are again important at the stage of peeling off the image plus resin layer from the base material. In the final construction, cohesion of the toner image, adhesion of the image to the resin layer, and cohesion of the resin layer remain important to the overall durability.

A test was devised to check on the adhesion of a toner image to a resin layer so that a good combination may be selected. A sheet of release paper, e.g. Stace 3672, was coated with an image receiving film which was 3 microns thick when dry. This sheet was fed through a photocopier to receive an image. The sheet was placed image side up on a work surface and the image wiped carefully with soft tissue to remove surplus oil. A sheet of 3M transparent vinyl adhesive film No. 180-114 was laminated on the image and the paper image carrier stripped away. With the image receiving film now uppermost, a strip of the same vinyl adhesive film was pressed on it leaving one end free.

The tape was then removed in two stages, a gentle peel followed by a sharp snatch. Ideally the gentle peel should remove the tape from the resin and not remove any polymer and the sharp snatch should randomly remove or leave the combination of polymer film plus toner image.

Ways to optimise adhesion of resin to toner image include variation of the composition of the resin and the inclusion of materials such as Aerosil 200, a pyrogenic silica made by Degussa and naturally occurring clays such as Fullers Earth. Such materials may be included in amounts up to 33% by weight of the resin layer.

The addition of a plasticiser may also be useful to soften the resin coating when cutting the edges of tiles. This reduces edge damage and contributes towards reducing the visibility of joins. A suitable material is Dibutylphthalate and this can be useful in concentrations up to 30% of the weight of resin. Other additions such as u.v. stabilisers may also be incorporated.

It is essential to attempt to match the electrical properties of the image receiving sheet, that is the carrier sheet plus its strippable resin coating, with the properties which the copier machine manufacturers have designed their machine to require. Although a gross mismatch will be obvious in producing very badly imaged sheets, similar effects can occur in an irregular way. It is known that ordinary paper, for example, under conditions of moderately high humidity, e.g. 60% can produce imperfect images consisting of patches of low density image. It has been found that some combinations of resin coating with certain release papers will under conditions of low humidity, e.g. 20% produce a varying proportion of faulty images containing patches and bands of low density.

These faults can be cured by coating the back side with conventional ionic antistatic compounds or incorporating in either the strippable film or a back coating, compounds of the type claimed in GB 2,021,797, Stevens et al.

The preferred flexible plastics sheet for the first and second substrates is commercially available from 3M United Kingdom PLC under the trade names "Controltac" and "Scotchcal", and is a vinyl film bearing a pressure activated or pressure sensitive adhesive coating on at least one side, available in clear, pigmented and reflective forms. The film constituting the first substrate is bonded, via the adhesive, to the toner image by any conventional laminating technique, e.g., pressure rollers, squeegee, etc. Alternatively, any other flexible plastic film may be used, in conjunction with an adhesive applied either to the film itself or to the toner image. However, it is important that neither the plastics film, nor its associated adhesive, should readily degrade or discolour on exposure to sunlight, rain etc. Likewise, the film constituting the second substrate is bonded to the resin layer after the latter (together with the toner image and first substrate) has been stripped from the flexible base material. At least one of the first and second substrates must be transparent in order for the image to be visible. If one of these films is opaque, e.g., white, it is preferable that it be used in step (e) rather than step (c), otherwise the image perceived will be a mirror image of the original, which will be unacceptable in many situations. It is possible to reverse the image if there is a reason why the opaque film is to be used in step (c). For some applications, e.g. window displays, it is preferable for both substrates to be transparent, but for use on walls, vehicle sides, etc., it is preferable that the second substrate be opaque (e.g. white) to ensure uniformity of image visibility. Visibility under conditions of night-time illumination may be maximised by use of reflective (especially retroreflective) material as the second substrate. A preferred retroreflective material is 3M "SCOTCHLITE" brand film commercially available from Minnesota Mining and Manufacturing Company, U.S.A.

For use as a sign, an adhesive may be applied to the outermost surface of one of the plastics sheets. Normally, this will be the opaque plastics sheet (if used). More conveniently, that plastics sheet will already bear such an adhesive layer, protected by a strippable liner. By this means, the entire construction may be attached in the desired position. In the preferred embodiment, the construction is conformable to curved surfaces and to surface irregularities, e.g., rivets, welded seams, etc. By suitable choice of the adhesive used to mount the construction in position, it is possible to obtain a sign that is durable under normal conditions of use, but strippable, e.g., on application of heat.

On account of the toner image being sandwiched between two durable continuous plastic sheets, it is protected from the elements, and thus the coloured image shows excellent weatherability. The addition of u.v. absorbers to the plastics sheets can further improve the weatherability of the image.

Any photocopier may be used in principle, but preferably the photocopier is a colour copier with an enlargement facility. A suitable photocopier is the Canon Colour Laser Copier which has the ability to output an electronically-stored image in sections at a predetermined level of magnification. By this means, a relatively large image is output as a series of A4 or A3 sized sections ("tiles"), each of which bears a portion of the final image. When these are trimmed as necessary and placed in edge-to-edge abutment, the complete image is displayed. Using this facility with the method of the invention, one completes steps (a) and (b) individually for each tile, before assembling the tiles in mutual registration, and then completes steps (c) to (e) on the assembly.

The invention will now be illustrated by the following Examples.

EXAMPLE 1

This Example illustrates the use of the invention to produce an enlarged picture of an original, the final sign being composed of a number of images butted together with virtually invisible joins and covered top and bottom by continuous sheets of vinyl.

A length of silicone treated paper (product number 639 commercially available from L. Stace Limited), having a release value of from 15–20g/25mm (Release paper Manufacturers Association Test Method), was coated with a wet layer of a 10% w/w solution of VAGH in a 1:1 mixture of 2-butanone and toluene using a knife coater. The coating was dried in a hot air stream to give a dry coating thickness of 3μm and the paper cut into four A4 sized sheets. These were placed in the cassette of a Canon Colour Laser Copier. A coloured A4 size original was placed on the top glass and the machine set to produce an enlarged image on four A4 sheets.

The four imaged sheets obtained from the machine were lightly stuck down on a work surface with the images in mutual registration, overlaps were trimmed off and good butt joins made. A sheet of clear vinyl having a coating of pressure activated adhesive was applied over the image and squeegeed down well, edges were trimmed before lifting the vinyl sheet plus image and VAGH layer from the silicone paper. A white vinyl sheet having a coating of pressure activated adhesive was placed adhesive side up on the work surface and then the composite of clear vinyl, image and VAGH layer squeegeed down to laminate the image. After applying adhesive to the backside of the white vinyl, the sign was ready for mounting.

EXAMPLE 2

This Example shows how cohesion between the layers varies with the selection of resin.

Three styrene/methylacrylate copolymers in the ratios of 40:60, 70:30, 8:20 were dissolved separately to make 15% w/w solutions in a 3:2 mixture of toluene and 2-butanone. Each was coated on Stace 36/72 paper using a knife coater to give a dry coating thickness of 3 microns. An A4 size sheet from each coating was placed in the cassette of a Canon Colour Laser Copier and a coloured A4 size original was placed on the top glass. Standard copies were obtained on each sheet. The sheets were in turn lightly stuck down on a work surface, wiped lightly to remove any silicone oil and a sheet of clear adhesive vinyl applied and squeegeed down well. Edges were trimmed then the vinyl carrying the image was lifted from the paper. All sheets were placed vinyl side down on a surface and a strip of the same adhesive vinyl applied to the polymer film. The strip was then removed at first slowly and then with a sharp snatch.

The 40:60 copolymer was removed leaving the image under both conditions.

The 70:30 copolymer under slow peel conditions was partly removed and partly released from the tape strip. Under snatch conditions the polymer was largely removed from the image except in a few places where the image was also lifted.

Under slow peel conditions the adhesive tape was removed from the 80:20 copolymer and under snatch conditions, chatter lines were produced with the polymer plus image alternating between upper and lower adhesives.

EXAMPLE 3

To a 10% w/w solution of VAGH in a 1:1 mixture of toluene and 2-butanone was added Aerosil 200 (a pyrogenic silica made by Degussa) in an amount equal to 30% of the weight of VAGH. This was coated on Stace 3672 paper using a knife coater to give a dry coating thickness of 3 micron. An A4 sheet was cut, imaged and tested as in Example 2. Behaviour was similar to the 80:20 copolymer in that VAGH did not detach from the image in significant areas. In this case in some areas the whole layer went with either the top or bottom adhesive but in others there was splitting at varying levels in the combined layer.

Comparison with a sheet of VAGH coating without silica showed in this case a major tendency for the VAGH to be removed from the image.

EXAMPLE 4

To a 10% w/w solution of VAGH in a 1:1 mixture of toluene and 2-butanone was added dibutylphthalate in an amount equal to 30% of the weight of VAGH. This was coated on Stace 3672 paper using a knife coater to give a dry coating thickness of 3 micron. Four A4 size sheets were cut and treated as in Example 1 to produce a sign having an enlarged image.

With the plasticiser present it was easier to maintain good edges during the assembly process and the joins were unobvious from a closer distance.

EXAMPLE 5

A coloured image on a reflective backing was produced by following the procedure described in Example 1 but replacing the white vinyl sheet with a retroreflective sheet commercially available from Minnesota Mining and Manufacturing Company under the trade mark "Scotchlite" bearing on the reflective side a layer of pressure sensitive adhesive applied by aerosol spray commercially available from Minnesota Mining and Manufacturing Company under the trade mark "Spraymount". The resulting sign showed enhanced visibility under both day- and night-time illumination.

What is claimed is:

1. A method of producing an image on a substrate which method comprises:

(a) providing a carrier sheet comprising a flexible base material having on one surface thereof a strippable resin layer;

(b) imaging said carrier by passage through an electrophotographic copying apparatus so that a toner image is deposited and fused on said strippable resin layer;

(c) adhesively bonding a first substrate to the side of the carrier sheet bearing the toner image formed in step (6);

(d) stripping, from said flexible base material, the composite comprising said first substrate, toner image and resin layer, and, (e) adhesively bonding a second substrate to the resin layer of the composite, wherein at least one of the first and second substrates is transparent.

2. A method of reproducing an image on a substrate, which method comprises:

(a) providing a plurality of carrier sheets, each comprising a flexible base material having on one surface thereof a strippable resin layer;

(b) imaging each carrier sheet by passage through an electrophotographic copying apparatus so that a toner image corresponding to a section of a desired image is deposited and fused on said strippable resin layer of each sheet;

(c) adhesively bonding the side of each carrier sheet bearing said toner image to a first substrate, each carrier sheet being positioned such that the desired image is formed from the arrangement of the imaged carrier sheets;

(d) stripping from the composite comprising the first substrate, toner image and resin layer, the flexible base material of each carrier sheet, and, (e) adhesively bonding a second substrate to said resin layer, wherein at least one of the first and second substrates is transparent.

3. A method according to claim 2 wherein said first substrate is transparent.

4. A method according to claim 2 wherein said first substrate has on one surface thereof an adhesive layer for bonding to the imaged carrier sheet.

5. A method according to claim 4 wherein said second substrate has on one surface thereof an adhesive layer for bonding to the composite.

6. A method according to claim 2 wherein said first and/or second substrates comprise vinyl sheets.

7. A method according to claim 2 wherein said second substrate additionally comprises an adhesive layer and strippable release liner for mounting the completed image on a surface.

8. A method according to claim 2 wherein said flexible base material comprises a paper or plastics sheet.

9. A method according to claim 2 wherein said flexible base material has on one surface thereof a layer of a release material which is interposed between the resin layer and the base material.

10. A method according to claim 9 wherein said release material comprises a silicone or fluoropolymer resin.

11. A method according to claim 10 wherein said flexible base material comprises silicone treated paper.

12. A method according to claim 2 wherein said strippable resin is a member selected from the group consisting of poly (vinyl formal), poly(vinyl butyral), a vinyl chloride-vinyl acetate co-polymer and a hydroxyl-modified vinyl chloride-vinyl acetate co-polymer.

13. A method according to claim 12 wherein said strippable resin comprises a hydroxyl-modified vinyl chloride-vinyl acetate co-polymer having a composition comprising about 90% vinyl chloride and about 4% vinyl acetate, and having a hydroxyl content of about 2.3%.

14. A method according to claim 12 wherein said strippable resin additionally comprises up to 33% of a member selected from the group consisting of powdered silica and clay.

15. A method according to claim 2 wherein said strippable resin has a dry thickness of from 0.5 to 8$\mu$m.

16. A method according to claim 15 wherein said strippable resin has a dry thickness of from 1 to 5$\mu$m.

17. A method according to claim 2 wherein said electrophotographic copying apparatus has full colour capability and the image produced is a full colour image.

* * * * *